US011363902B1

(12) United States Patent
Durante

(10) Patent No.: US 11,363,902 B1
(45) Date of Patent: Jun. 21, 2022

(54) THEFT-RESISTANT BOX

(71) Applicant: Robert Dakotah Durante, Keithville, LA (US)

(72) Inventor: Robert Dakotah Durante, Keithville, LA (US)

( * ) Notice: Subject to any disclaimer, the term of this patent is extended or adjusted under 35 U.S.C. 154(b) by 120 days.

(21) Appl. No.: 16/983,565

(22) Filed: Aug. 3, 2020

(51) Int. Cl.
*A47G 29/20* (2006.01)
*A47G 29/30* (2006.01)
*A47G 29/124* (2006.01)

(52) U.S. Cl.
CPC ..... *A47G 29/20* (2013.01); *A47G 29/30* (2013.01); *A47G 29/124* (2013.01)

(58) Field of Classification Search
CPC ..... A47G 29/20; A47G 29/30; A47G 29/124; A47G 29/1216; A47G 29/1209; A47G 29/14; A47G 29/16; G07F 9/06; G06F 1/181; H05K 5/0217; H05K 5/0208; H05K 5/0234
USPC ..... 232/27, 7, 15, 16, 17, 19, 39, 45; 248/146, 154, 219.4; 361/724, 725, 726
See application file for complete search history.

(56) References Cited

U.S. PATENT DOCUMENTS 3,268,158 A 8/1966 Abbott
3,667,405 A * 6/1972 Roach, Jr. ..... E04H 12/18 109/51
3,758,026 A 9/1973 Henderson
3,874,583 A * 4/1975 Moll ..... A47G 29/12095 D99/32
4,037,700 A 7/1977 Heraty
5,193,774 A 3/1993 Rogers
5,507,378 A 4/1996 Leone
5,967,359 A 10/1999 Mindell
6,805,515 B2 10/2004 Reale
7,475,859 B2 1/2009 Selders
7,549,572 B1 * 6/2009 Branan ..... A47G 29/22 232/52
7,896,226 B1 * 3/2011 Branan ..... A47G 29/22 232/52
8,305,289 B2 11/2012 Lo
9,599,299 B2 * 3/2017 Hoang ..... F21S 8/085
2005/0247771 A1 * 11/2005 Engel ..... A47G 29/12095 232/27
2009/0237918 A1 9/2009 Yang
2010/0263968 A1 10/2010 Petner
(Continued)

FOREIGN PATENT DOCUMENTS

WO WO-2014030865 A1 * 2/2014 ..... E05G 1/005

*Primary Examiner* — William L Miller
(74) *Attorney, Agent, or Firm* — R. Keith Harrison

(57) ABSTRACT

Theft-resistant enclosure systems may include an enclosure having an enclosure interior. An enclosure door may be carried by the enclosure. The enclosure door may be selectively positional in opened and closed positions and selectively lockable in the closed position. At least one enclosure mount member may extend through the enclosure interior of the enclosure. At least one anchoring device may anchor the at least one enclosure mount member outside the enclosure interior of the enclosure. At least one enclosure mounting assembly may be disposed in the enclosure interior of the enclosure. The at least one enclosure mounting assembly may secure the enclosure to the at least one enclosure mount member. Theft-resistant enclosure installation methods are also disclosed.

18 Claims, 12 Drawing Sheets

(56) References Cited

U.S. PATENT DOCUMENTS

| | | | | |
|---|---|---|---|---|
| 2016/0157653 | A1 | 6/2016 | Manitta | |
| 2020/0281383 | A1 * | 9/2020 | Butler | A47G 29/1209 |

* cited by examiner

THEFT-RESISTANT BOX

FIELD

Illustrative embodiments of the disclosure generally relate to theft deterrent systems and devices. More particularly, illustrative embodiments of the disclosure relate to theft-resistant enclosure systems having an enclosure which can be mounted on a vertical enclosure mount member to contain and secure any of various articles, electrical components or the like and methods of installing theft-resistant enclosures.

SUMMARY

Illustrative embodiments of the disclosure are generally directed to theft-resistant enclosure systems having an enclosure which can be mounted on a vertical enclosure mount member to contain and secure any of various articles, electrical components or the like. An illustrative embodiment of the theft-resistant enclosure systems may include an enclosure having an enclosure interior. An enclosure door may be carried by the enclosure. The enclosure door may be selectively positional in opened and closed positions and selectively lockable in the closed position. At least one enclosure mount member may extend through the enclosure interior of the enclosure. At least one anchoring device may anchor the at least one enclosure mount member outside the enclosure interior of the enclosure. At least one enclosure mounting assembly may be disposed in the enclosure interior of the enclosure. The at least one enclosure mounting assembly may secure the enclosure to the at least one enclosure mount member.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
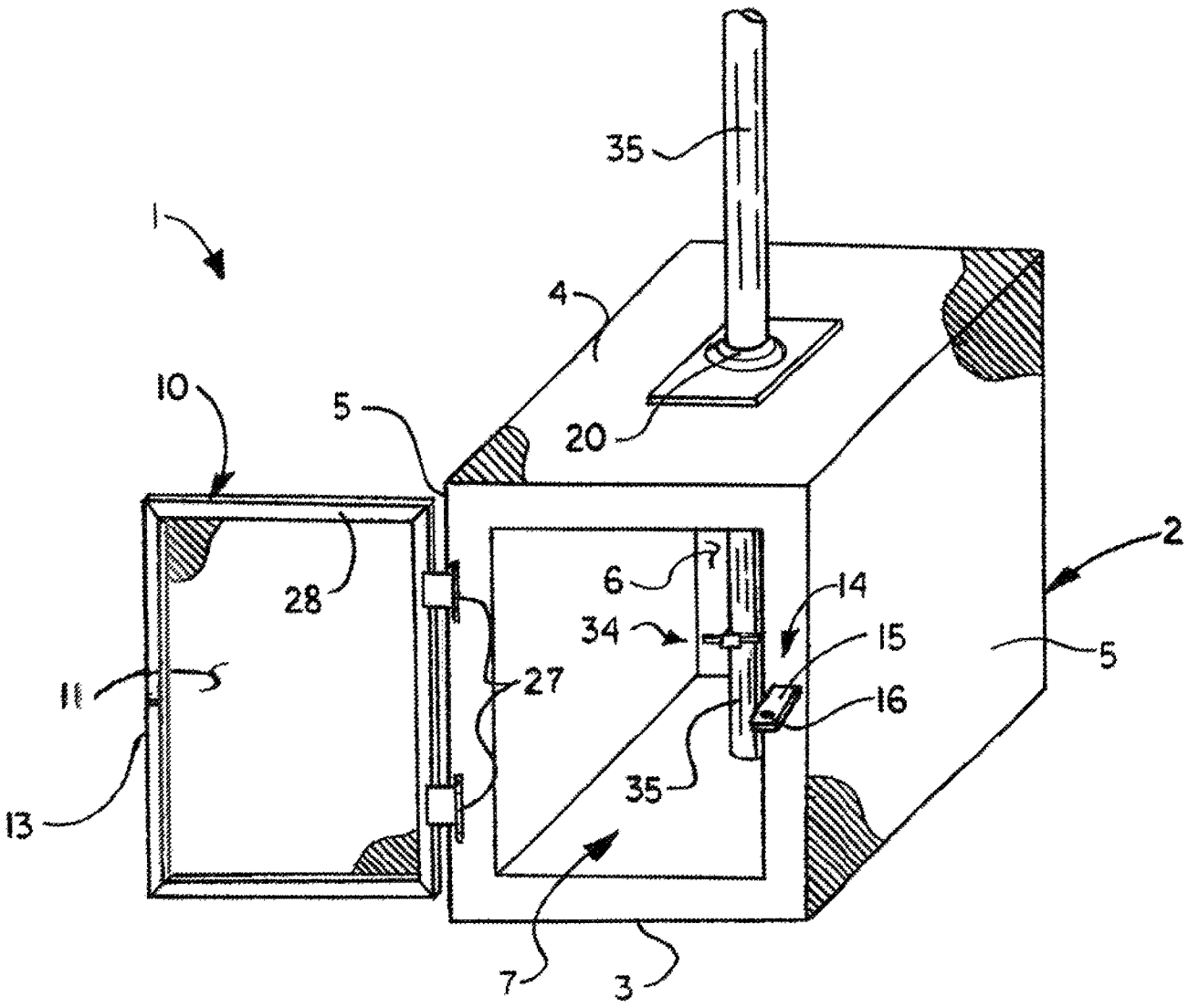
FIG. 1 is a front perspective view of an illustrative embodiment of the theft-resistant enclosure systems, having an enclosure mounted on a vertical enclosure mount member, with an enclosure door in an open position and an enclosure mounting assembly in the enclosure interior of the enclosure and mounting the enclosure to the enclosure mount member.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "let", "rear", "right", "front". "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 11:
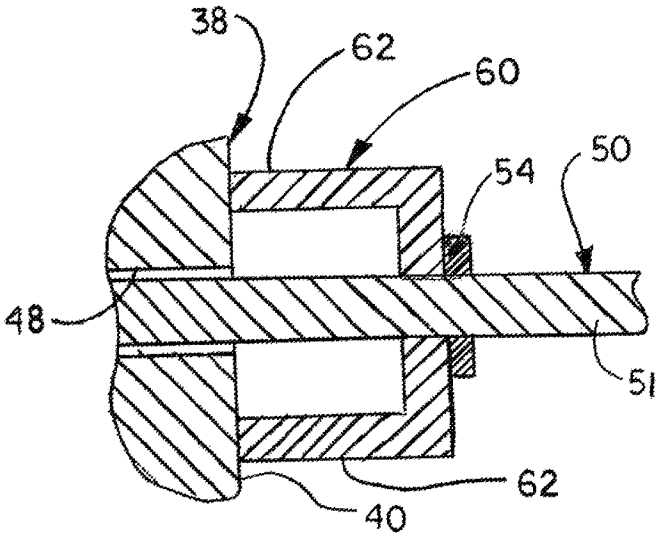
FIG. 11 is an enlarged sectional view, taken along section line 11 in FIG. 10, of an exemplary main support member of the typical assembled enclosure mounting assembly, with a securing member arm of a securing member extending through the main support member.
Figure 12:
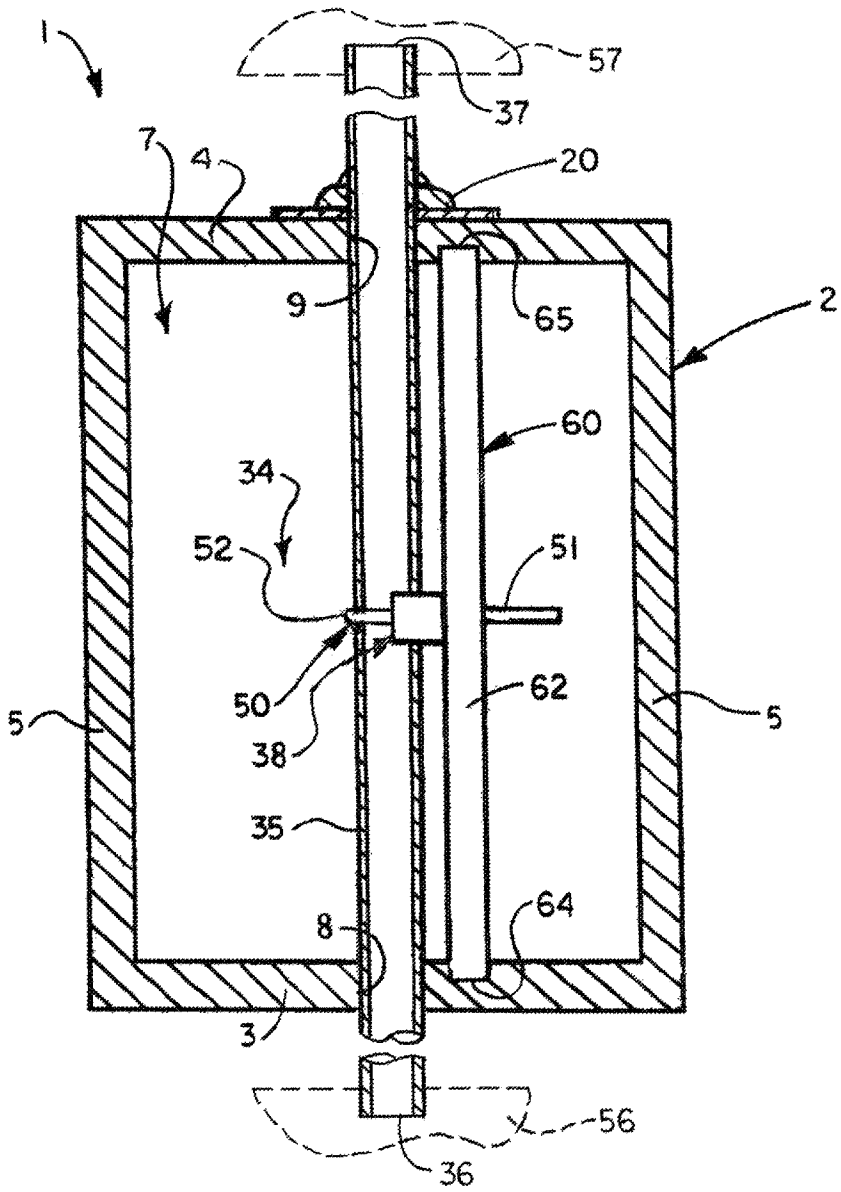
FIG. 12 is a sectional view of the illustrative theft-resistant enclosure system with the enclosure mounting assembly mounting the enclosure on the enclosure mount member.

Referring initially to FIGS. 1-15 of the drawings, an illustrative embodiment of the theft-resistant enclosure systems, hereinafter system, of the disclosure is generally indicated by reference numeral 1. The system 1 may include an enclosure 2. In typical application of the system 1, which will be hereinafter described, the enclosure 2 may contain any of various articles or electrical switches and/or other components or items (not illustrated), access to which is intended to be restricted to authorized personnel. In some embodiments, the enclosure 2 may be generally rectangular or box-shaped, as illustrated. Accordingly, the enclosure 2 may include an enclosure floor 3, an enclosure top wall 4, enclosure side walls 5, an enclosure rear wall 6 and an enclosure interior 7. In alternative embodiments, the enclosure 2 may have other designs including but not limited to spherical, oval, pyramidal, hexagonal and octagonal shapes. As illustrated in FIG. 12, a lower mount member opening 8 and an upper mount member opening 9 may extend through the enclosure floor 3 and the enclosure top wall 4, respectively, for purposes which will be hereinafter described.

Figure 2:
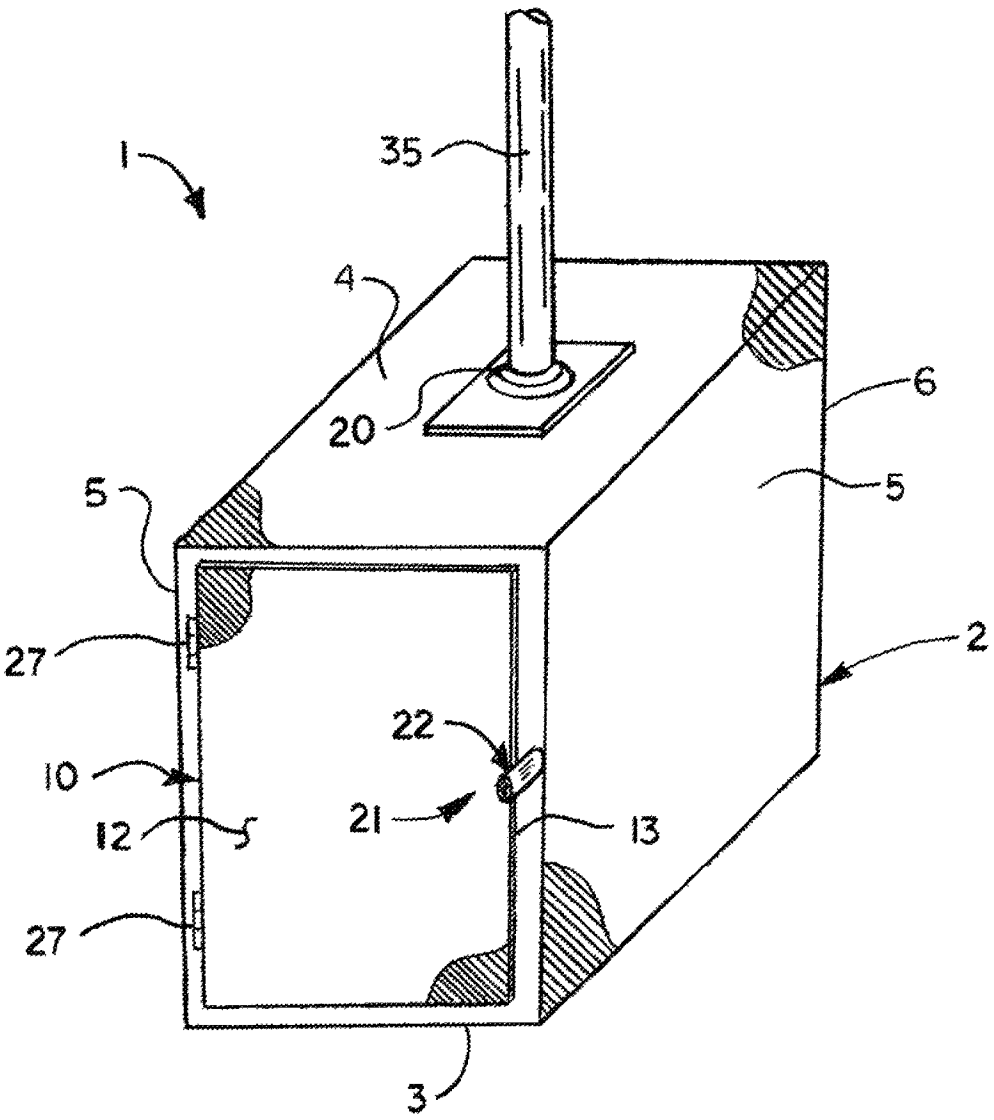
FIG. 2 is a front perspective view of the illustrative theft-resistant enclosure system with the enclosure door in the closed position.
Figure 3:
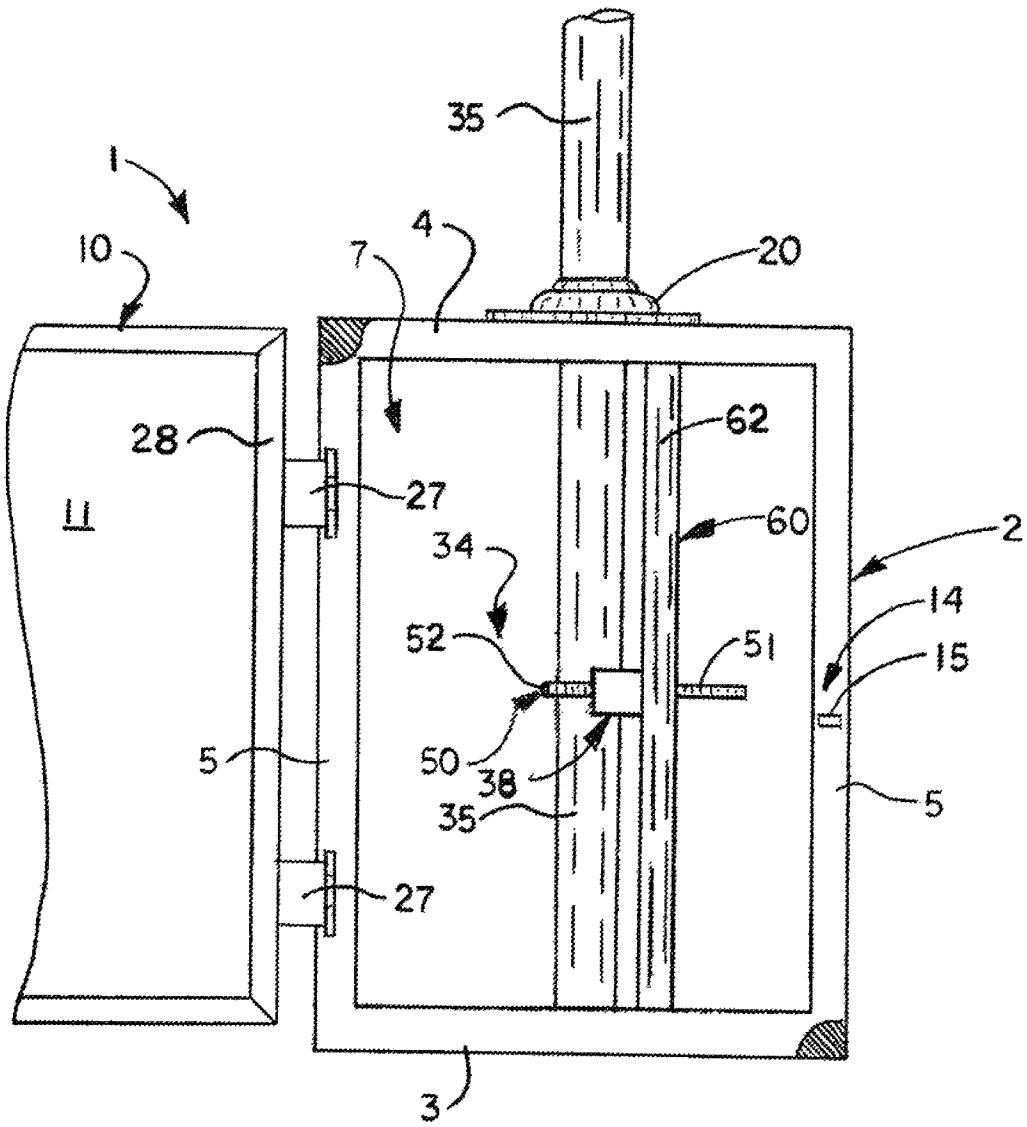
FIG. 3 is a front view of the illustrative theft-resistant enclosure system with the enclosure door (partially in section) opened.

An enclosure door 10 may be pivotally attached to the enclosure 2. The enclosure door 10 may have an interior door surface 11 (FIG. 1), an exterior door surface 12 (FIG. 2) and an outer door edge 13. At least one enclosure door hinge 27 may pivotally attach the enclosure door 10 to the enclosure 2. The enclosure door 10 may be suitably sized and configured to substantially close the enclosure interior 7 of the enclosure 2 in the closed position, as illustrated in FIG. 2. In some embodiments, at least one door gasket 28 (FIG. 1) may be provided on the interior door surface 11 of the enclosure door 10 to impart a substantially airtight seal with the enclosure 2 in the closed position of the enclosure door 10. The enclosure 2 and the enclosure door 10 of the system 1 may be fabricated of steel, aluminum, composite fiber and/or other suitable materials with sufficient strength and rigidity to render the system 1 theft-resistant and resistant to unauthorized access.

Figure 14:
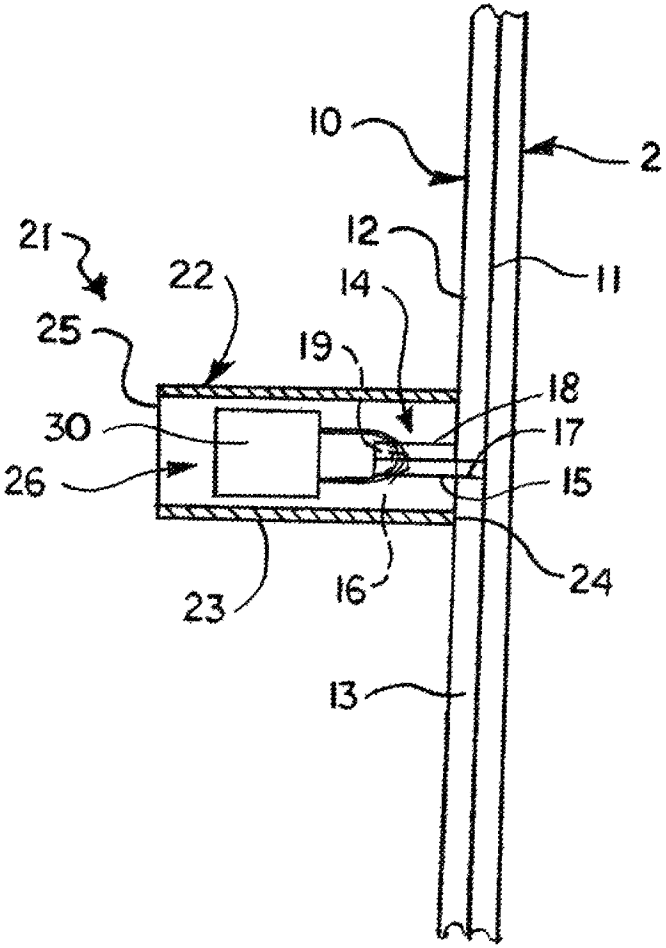
FIG. 14 is a sectional view of the lock shield assembly with the enclosure door closed on the enclosure and a door lock securing the enclosure door in the closed position and disposed inside a lock shield of the lock shield assembly.
Figure 13:
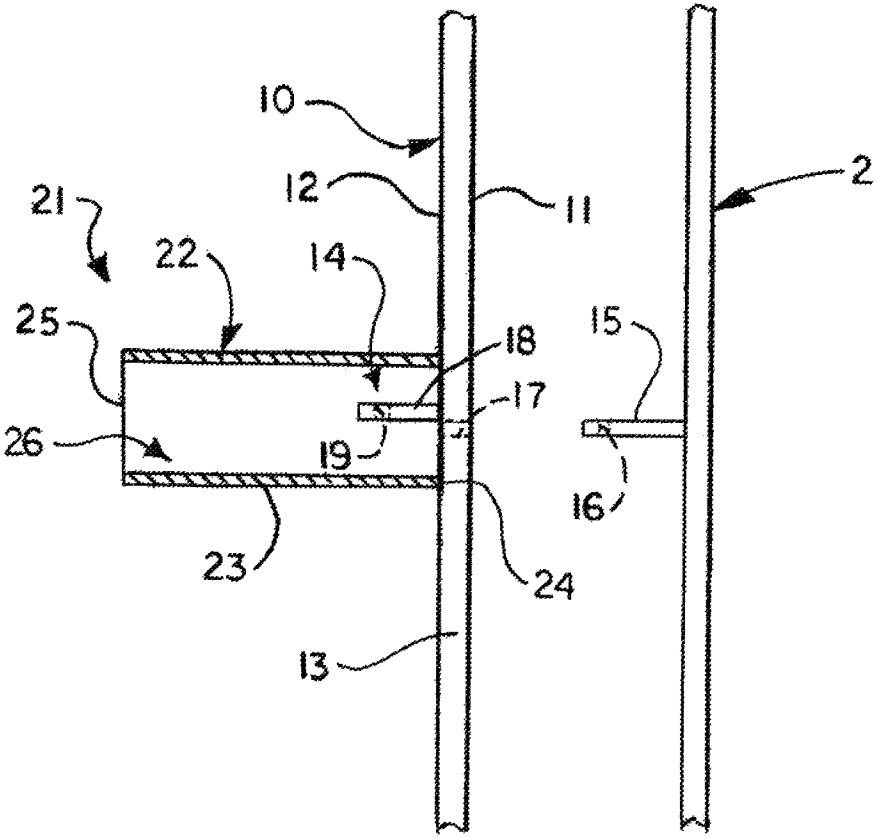
FIG. 13 is a sectional view of a typical lock shield assembly on the enclosure door of the enclosure, with the enclosure door in the open position.

As illustrated in FIGS. 13 and 14, at least one door latch 14 may be selectively engaged to maintain the enclosure door 10 in the closed position on the enclosure 2. In some embodiments, the door latch 14 may include an enclosure flange 15 which may extend forwardly from the enclosure 2. An enclosure flange opening 16 may extend through the enclosure flange 15. A door flange 18 may extend forwardly from the enclosure door 10. A door flange opening 19 may extend through the door flange 18. Accordingly, in the closed position of the enclosure door 10, as illustrated in FIG. 14, the door flange opening 19 in the door flange 18 may align or register with the enclosure flange opening 16 in the enclosure flange 15. As further illustrated in FIG. 14, a door lock 30 such as a padlock, for example and without limitation, may be selectively extended through the aligned or registering enclosure flange opening 16 and door flange opening 19 and locked or secured to lock the enclosure door 10 in the closed position on the enclosure 2.

In some embodiments, at least one vent (not illustrated) may be provided in the enclosure 2 and/or the enclosure door 10. The vent may be provided in the enclosure floor 3, the enclosure top wall 4, the enclosure side wall or walls 5, the enclosure rear wall 6 and/or the enclosure door 10.

In some embodiments, at least one knock-out opening (not illustrated) may be provided in the enclosure 2 and/or the enclosure door 10. The knock-out opening may be attached via perforations and may be removed to facilitate passage of wiring, cables and the like between the enclosure interior 7 and the outside of the enclosure 2. The knock-out opening or openings may be provided in the enclosure floor 3, the enclosure top wall 4, the enclosure side wall or walls 5, the enclosure rear wall 6 and/or the enclosure door 10.

As illustrated in FIGS. 2, 13 and 14, in some embodiments, a lock shield assembly 21 may be configured to substantially enclose the door lock 30 and the enclosure flange 15 and door flange 18 of the door latch 14 in the closed, latched and locked position of the enclosure door 10. Accordingly, the lock shield assembly 21 may include a lock shield 22. The lock shield 22 may extend forwardly from the exterior door surface 12 of the enclosure door 10 typically adjacent to the outer door edge 13. The lock shield 22 may include a lock shield wall 23. In some embodiments, the lock shield wall 23 of the lock shield 22 may be generally elongated and cylindrical, as illustrated. As illustrated in FIGS. 13 and 14, the lock shield wall 23 may have a proximal shield end 24 at the exterior door surface 12 of the enclosure door 10 and a distal shield end 25 opposite the proximal shield end 24. The proximal shield end 24 of the lock shield wall 23 may be fabricated in one piece with, or alternatively, may be casted, molded, welded and/or otherwise attached to the exterior door surface 12 of the enclosure door 10 using mechanical fasteners and/or other suitable fastening techniques known by those skilled in the art. A lock shield interior 26 may extend from the proximal shield end 24 to the distal shield end 25.

Figure 15:
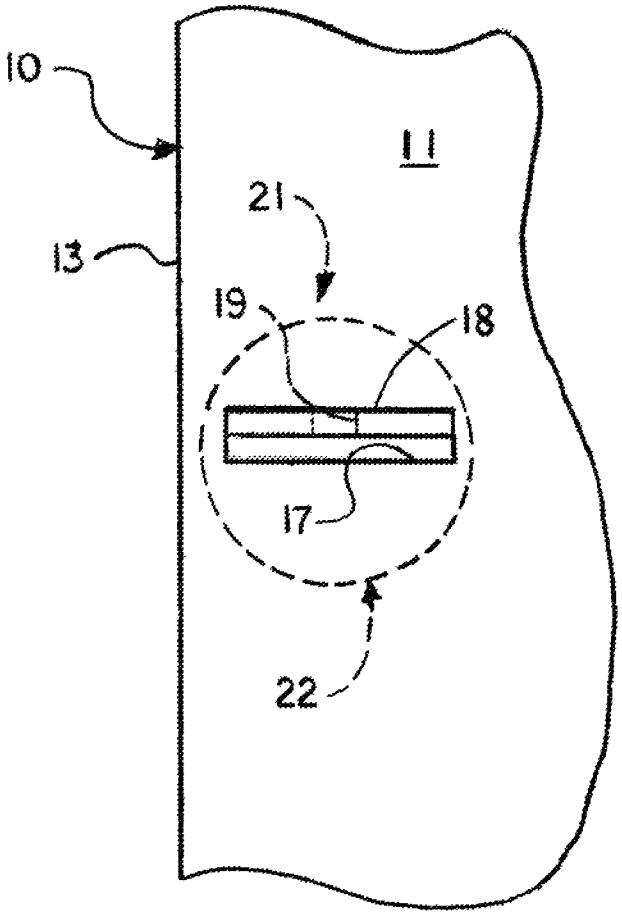
FIG. 15 is a sectional view of an interior surface of the enclosure door, more particularly illustrating the lock shield assembly (illustrated in phantom in rear view) on the enclosure door.

As illustrated in FIG. 13, the door flange 18 of the door latch 14 may extend from the exterior door surface 12 of the enclosure door 10 into the lock shield interior 26 of the lock shield 22. As illustrated in FIGS. 13-15, an enclosure flange slot 17 may extend through the enclosure door 10 typically beneath the door flange 18. Accordingly, as the enclosure door 10 is pivoted from the open position (FIG. 13) to the closed position (FIG. 14) on the enclosure 2, the enclosure flange 15 may insert through the enclosure flange slot 17 into the lock shield interior 26 of the lock shield 22 typically beneath the door flange 18 as the enclosure flange opening 16 in the enclosure flange 15 aligns or registers with the door flange opening 19 in the door flange 18, as illustrated in FIG. 14. The door lock 30 may be extended through the open distal shield end 25 into the lock shield interior 26 of the lock shield 22, inserted through the enclosure flange opening 16 and registering door flange opening 19 and locked or secured. Accordingly, the lock shield 22 may prevent an unauthorized person from accessing and cutting the enclosure flange 15, door flange 18 and/or door lock 30 using bolt cutters or the like in an attempt to open the enclosure door 10 on the enclosure 2 and gain unauthorized access to the enclosure interior 7 of the enclosure 2. In some embodiments, the door latch 14 may include at least one traction latch known by those skilled in the art. The traction latch may facilitate closure of the enclosure door 10 on the enclosure 2 without having to lock the enclosure door 10.

As illustrated in FIGS. 1-12, at least one enclosure mount member 35 may securely mount the enclosure 2. The enclosure mount member 35 may include at least one pole, post, frame, beam and/or other elongated member or members which extends through the enclosure interior 7 of the enclosure 2 and is mounted or secured exteriorly of the enclosure interior 7. For example and without limitation, in some embodiments, the enclosure mount member 35 may extend vertically through the enclosure interior 7, as illustrated. Accordingly, as illustrated in FIG. 12, the enclosure mount member 35 may extend through a lower mount member opening 8 in the enclosure floor 3 and through an upper mount member opening 9 in the enclosure top wall 4 of the enclosure 2. The enclosure mount member 35 may be welded to the enclosure 2 at the lower mount member opening 8 and the upper mount member opening 9. In some embodiments, at least one attachment cap 20 may attach at least one of the enclosure floor 3 and the enclosure top wall 4, as illustrated, to the enclosure mount member 35. In some embodiments, the attachment cap 20 may be welded to the corresponding enclosure floor 3 or enclosure top wall 4 and to the enclosure mount member 35.

As further illustrated in FIG. 12, a lower anchoring device 56 and/or an upper anchoring device 57 may anchor the lower mount member end 36 and/or upper mount member end 37, respectively, of the enclosure mount member 35 outside the enclosure interior 7. The lower anchoring device 56 and/or upper anchoring device 57 may include at least one bracket, flange, clamp and/or other mechanical fastener or combination of fasteners which are suitable for attaching the corresponding lower mount member end 36 and/or upper mount member end 37 typically to a concrete or metal structure or framework (not illustrated) according to the knowledge of those skilled in the art. Alternatively, the lower anchoring device 56 and/or the upper anchoring device 57 may include a concrete structure in which the lower mount member end 36 and/or the upper mount member end 37, respectively, of the enclosure mount member 35 may be embedded.

In alternative embodiments of the system 1, the enclosure mount member 35 may extend horizontally or at a diagonal or any other angle through the enclosure interior 7. For example and without limitation, in some embodiments, the enclosure mount member 35 may extend through respective side mount member openings (not illustrated) in the respective enclosure side walls 5 with one or both of the mount member ends 36, 37 of the enclosure mount member 35 mounted exterior to the enclosure interior 7 to one or more exterior structures or frameworks typically via the respective anchoring devices 56, 57.

At least one enclosure mounting assembly 34 may securely mount the enclosure 2 to the enclosure mount member 35 from inside the enclosure interior 7. As particularly illustrated in FIGS. 4-9, in some embodiments, the enclosure mounting assembly 34 may include at least one main support member 60. In some embodiments, the enclosure mounting assembly 34 may include a pair of elongated, parallel, spaced-apart main support members 60, as illustrated. Each main support member 60 may span the enclosure interior 7 of the enclosure 2. Accordingly, as illustrated in FIG. 12, each main support member 60 may have a lower support member end 64 and an upper support member end 65 which may be inserted and/or anchored in or attached to the respective enclosure floor 3 and enclosure top wall 4 of the enclosure 2 according to the knowledge of those skilled in the art. For example and without limitation, in some embodiments, the lower support member end 64 and upper support member end 65 of each main support member 60 may be welded to the enclosure floor 3 and the enclosure top wall 4, respectively. As they traverse the enclosure interior 7 typically from the enclosure floor 3 to the enclosure top wall 4, the main support members 60 may be disposed in substantially parallel and spaced-apart relationship with respect to each other and to the enclosure mount member 35.

As illustrated in FIGS. 4-11, in some embodiments, each main support member 60 of the enclosure mounting assembly 34 may have a channel shape in cross-section, typically with a main channel wall 61 and a pair of spaced-apart side channel walls 62 which extend longitudinally from the main channel wall 61 in parallel, spaced-apart relationship to each other. The cross-sectional channel shape may impart longitudinal structural rigidity and stability to each main support member 60. Each main support member 60 of the enclosure mounting assembly 34 may be fabricated of metal, rigid plastic, composite material and/or other strong, rigid material or materials suitable for the purpose.

At least one securing member 50 may be configured to anchor or secure the main support member or members 60 to the enclosure mount member 35. Each securing member 50 may have any design or configuration which is suitable for the purpose. Accordingly, in some embodiments, each securing member 50 may include at least one securing member arm 51. A mount member engaging portion 52 may extend from the securing member arm 51. Each securing member arm 51 may be suitably configured to engage a main support member 60. The mount member engaging portion 52 may be suitably configured to engage the enclosure mount member 35.

Figure 4:
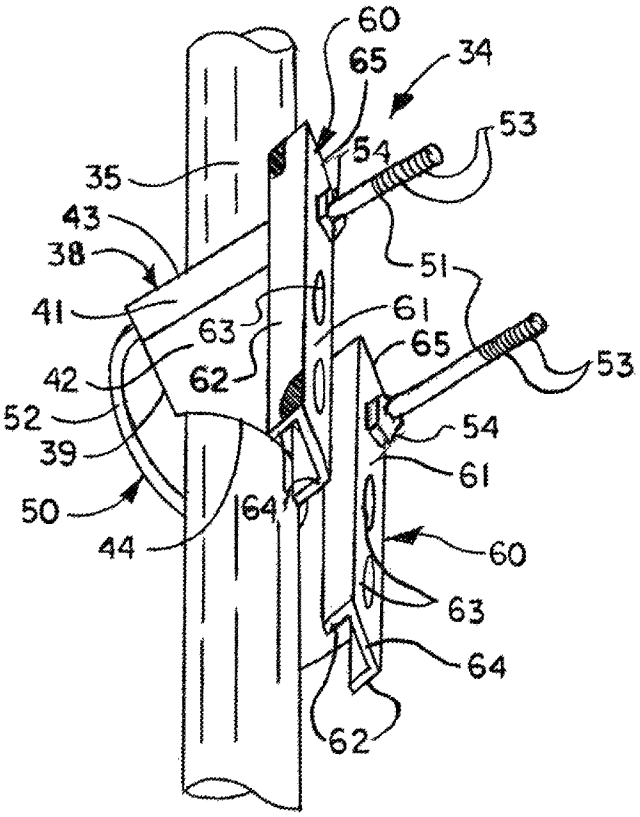
FIG. 4 is a bottom perspective view of a typical assembled enclosure mounting assembly suitable for mounting the enclosure on the enclosure mount member, with the enclosure mounting assembly engaging the enclosure mount member and the enclosure omitted for clarity.
Figure 7:
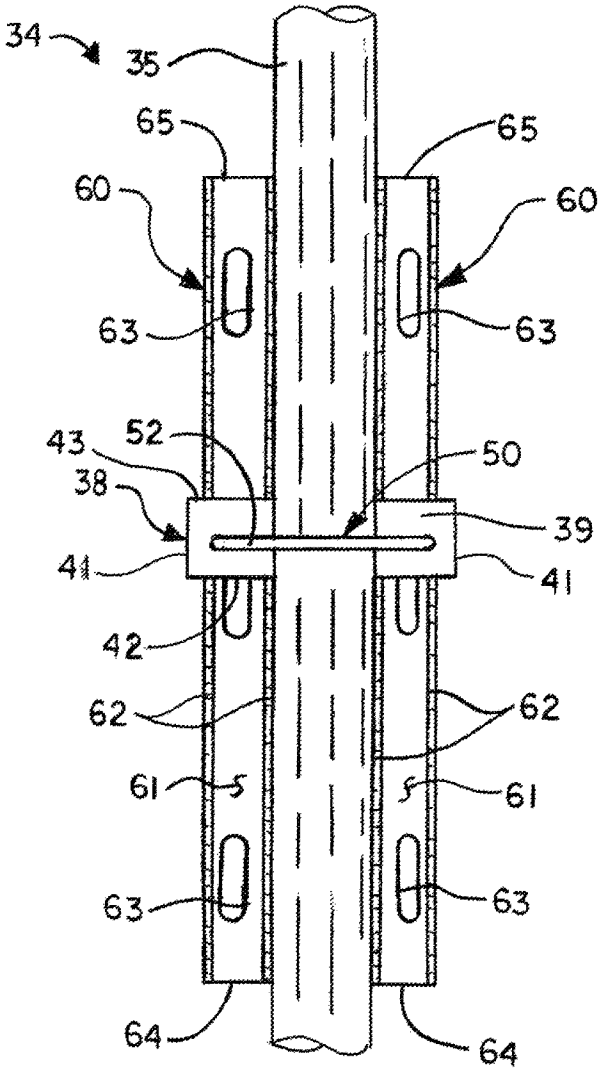
FIG. 7 is a rear view of the typical assembled enclosure mounting assembly.
Figure 6:
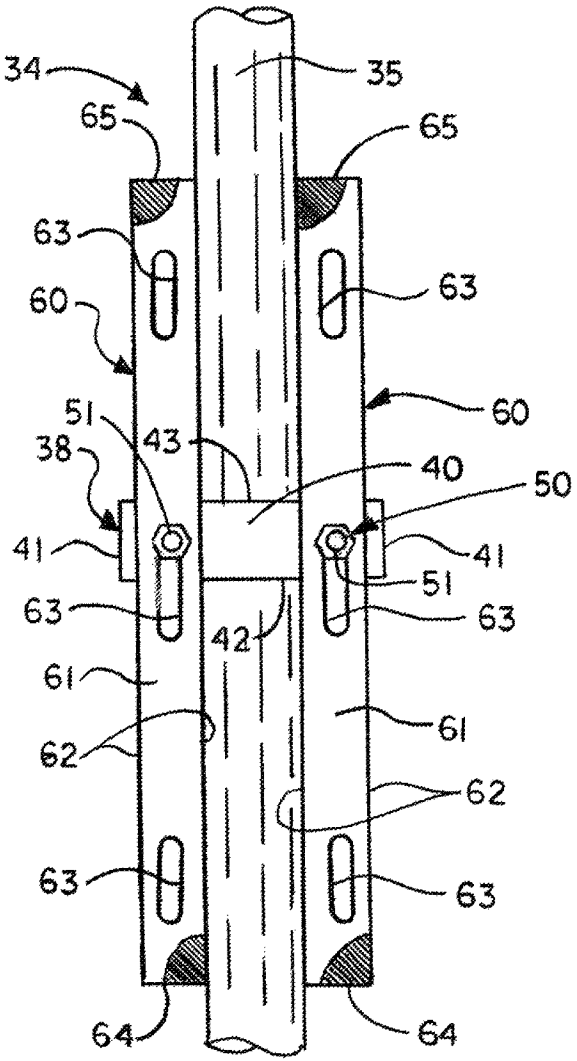
FIG. 6 is a front view of the typical assembled enclosure mounting assembly.

In some embodiments, each securing member 50 may include at least one U-bolt having a pair of parallel, spaced-apart securing member arms 51. Threads 53 may be provided on the extending end portions of the respective securing member arms 51. In some embodiments, the mount member engaging portion 52 may be curved to match the diameter or contour of the enclosure mount member 35, as illustrated. In other embodiments, the mount member engaging portion 52 may have alternative shapes which conform to the shape or contour of the enclosure mount member 35. As illustrated in FIGS. 4,6 and 7, at least one support member aperture 63 may extend through each main support member 60. Accordingly, the securing member arms 51 of the securing member 50 may be inserted through the support member apertures 63 in the respective main support members 60 as the mount member engaging portion 52 receives and engages the enclosure mount member 35. A pair of securing nuts 54 may be threaded on the threads 53 on the respective securing member arms 51 and tightened against the respective main support members 60 to tighten the mount member engaging portion 52 of the securing member 50 against the enclosure mount member 35.

Figure 5:
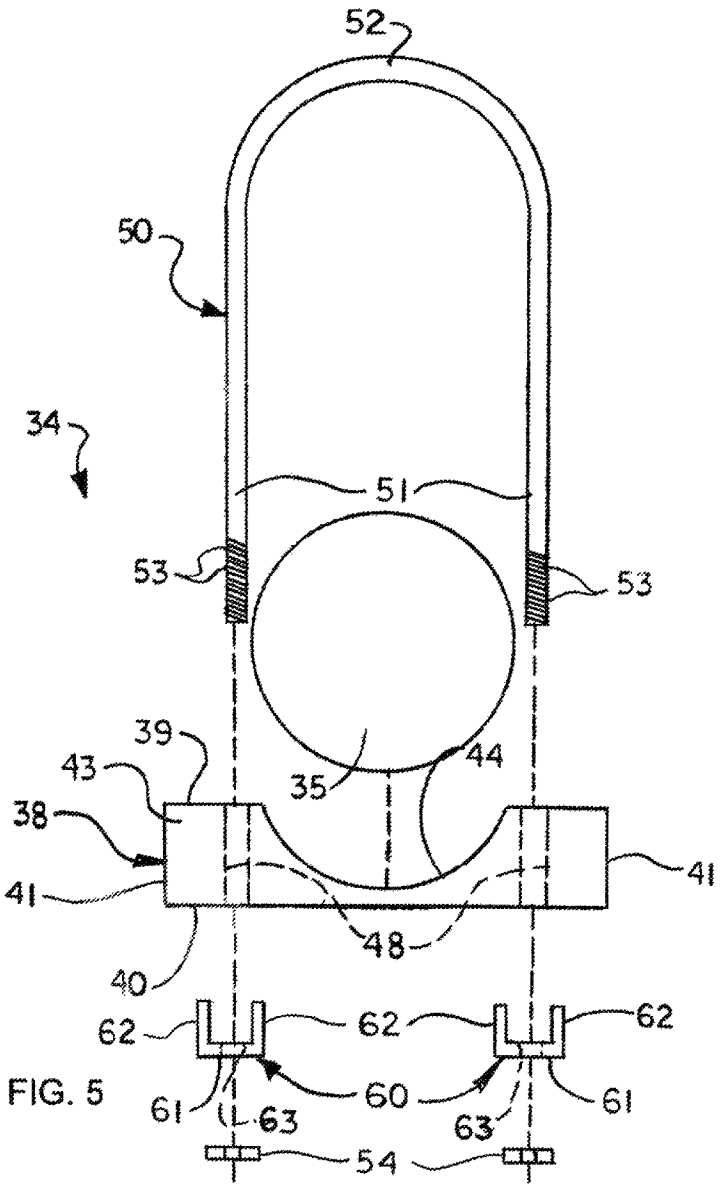
FIG. 5 is an exploded top view of the typical enclosure mounting assembly.
Figure 10:
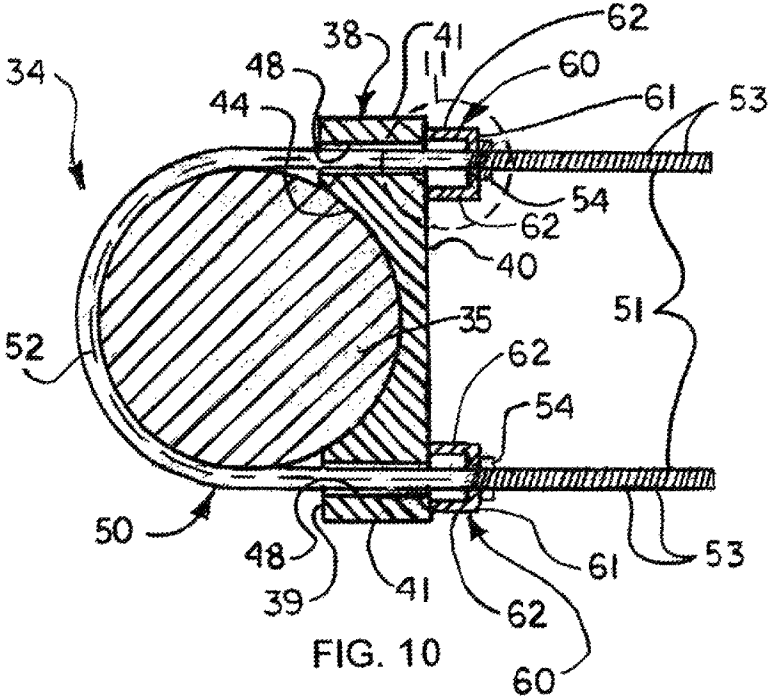
FIG. 10 is a sectional view of the typical assembled enclosure mounting assembly.

The enclosure mounting assembly 34 may further include at least one alignment bracket 38. In typical assembly of the enclosure mounting assembly 34, the alignment bracket 38 may facilitate alignment of the securing member arms 51 of the securing member 50 with the respective support member apertures 63 in the respective main support members 60. The alignment bracket 38 may include at least one mount member cavity 44 which is suitably sized and configured or contoured to receive the side of the enclosure mount member 35 which is opposite that which is engaged by the mount member engaging portion 52 of the securing member 50. As illustrated in FIGS. 5, 10 and 11, a pair of spaced-apart arm openings 48 may extend through the alignment bracket 38. The arm openings 48 may be suitably sized to accommodate the respective securing member arms 51 of the securing member 50 as the securing member arms 51 are extended through the support member apertures 63 and the mount member engaging portion 52 of the securing member 50 is deployed in place against the enclosure mount member 35.

Figure 9:
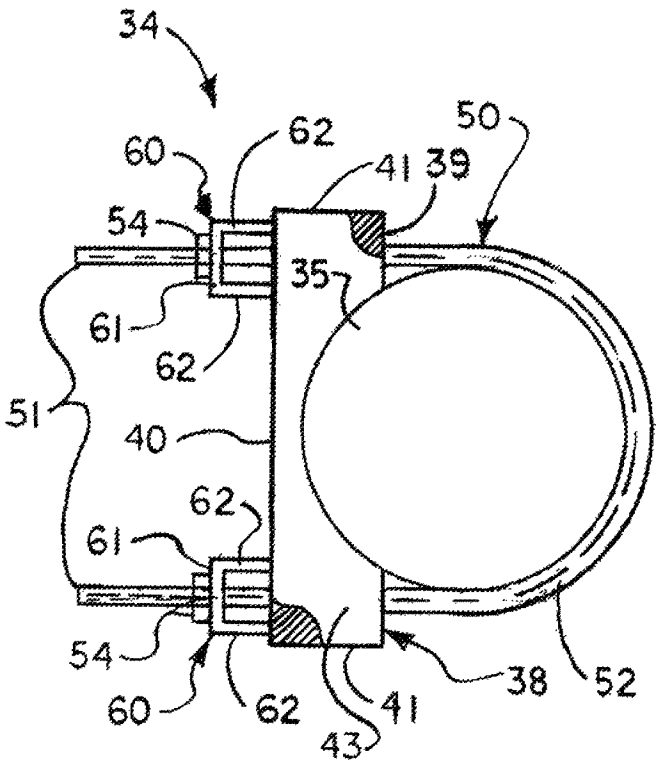
FIG. 9 is a top view of the typical assembled enclosure mounting assembly.
Figure 8:
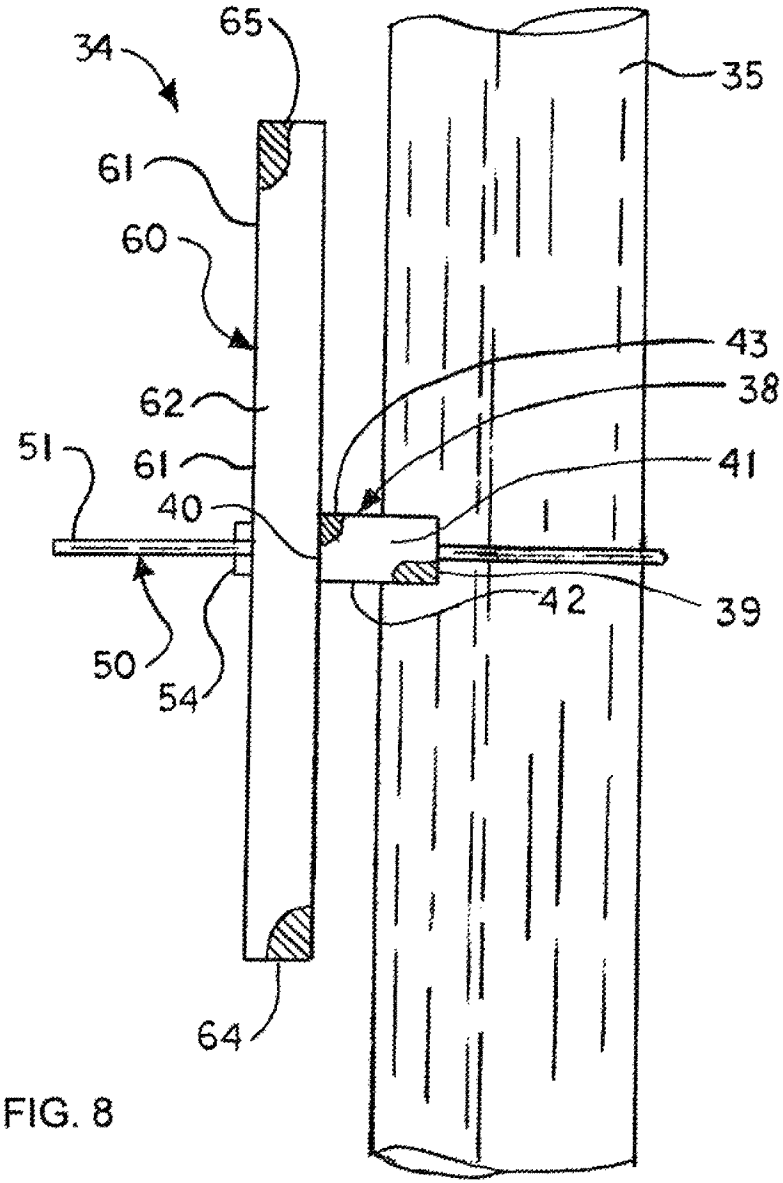
FIG. 8 is a side view of the typical assembled enclosure mounting assembly.

As illustrated in FIGS. 9 and 10, in some embodiments, the alignment bracket 38 may have an inner bracket surface 39, an outer bracket surface 40, a pair of side bracket surfaces 41, a lower bracket surface 42 (FIG. 4) and an upper bracket surface 43. In the assembled enclosure mounting assembly 34, the inner bracket surface 39 may generally face the enclosure mount member 35, and the main support members 60 may engage the outer bracket surface 40. As illustrated in FIG. 10, the mount member cavity 44 may extend into the inner bracket surface 39. Each arm opening 48 may extend through the alignment bracket 38 from the inner bracket surface 39 to the outer bracket surface 40.

In typical application, the system 1 may be assembled to contain any of various articles or electrical switches and/or other components or items, access to which is intended to be restricted to authorized personnel. Accordingly, as illustrated in FIG. 12, the lower support member end 64 and the upper support member 65 of each main support member 60 may be inserted in and/or anchored or attached to the enclosure floor 3 and the enclosure top wall 4, respectively, the enclosure mount member 35 may be extended through the lower mount member opening 8 and the upper mount member opening 9 (FIG. 12) in the enclosure floor 3 and enclosure top wall 4, respectively, of the enclosure 2, typically adjacent to the lower mount member opening 8 and the upper mount member opening 9. The enclosure mount member 35 may be extended through the lower mount member opening 8 and/or the upper mount member opening 9 and secured to the respective enclosure floor 3 and/or enclosure top wall 4 typically via welding. In some embodiments, at least one attachment cap 20 may additionally or alternatively secure the enclosure top wall 4, as illustrated, and/or the enclosure floor 3 of the enclosure 2 to the enclosure mount member 35, typically via welding and/or mechanical fastener attachment according to the knowledge of those skilled in the art.

The alignment bracket 38 may be placed between the main support members 60 and the enclosure mount member 35 as the mount member cavity 44 in the inner bracket surface 39 of the alignment bracket 38 receives the enclosure mount member 35 and the outer bracket surface 40 of the alignment bracket 38 typically engages or faces the main support members 60, as illustrated in FIGS. 9 and 10. The securing member 50 may then be placed around the side of the enclosure mount member 35 which is opposite the alignment bracket 38 as the securing member arms 51 of the securing member 50 are inserted first through the respective arm openings 48 (FIG. 5) in the alignment bracket 38 and then through the respective support member apertures 63 in the respective main support members 60. The nuts 54 may then be threaded on the threads 53 on the respective securing member arms 51 of the securing member 50 and against the respective main support members 60 to secure the alignment bracket 38 and the mount member engaging portion 52 of the securing member 50 against opposite sides of the enclosure mount member 35.

After the articles, components or items (not illustrated) access to which is intended to be restricted to the authorized personnel are placed in the enclosure interior 7, the enclosure door 10 may be pivoted to the closed position on the enclosure door hinges 27. As the enclosure door 10 closes against the enclosure 2, the enclosure flange 15 of the door latch 14 on the enclosure 2 may insert through the enclosure flange slot 17 in the enclosure door 10. As illustrated in FIG. 14, as the enclosure door 10 engages the enclosure 2, the door flange opening 19 in the door flange 18 may align or register with the enclosure flange 16 in the enclosure flange 15. The door lock 30 may be extended into the lock shield interior 26 of the lock shield 22 through the open distal shield end 25, extended through the enclosure flange opening 16 and door flange opening 19 and locked. Accordingly, the lock shield 22 may enclose and shield the enclosure flange 15, the door flange 18 and the door lock 30 and prevent unauthorized personnel from cutting those components and accessing the enclosure interior 7 of the enclosure 2. The key opening (not illustrated) on the door lock 30 may face the distal shield end 25 of the lock shield 22 for ease of access by enabling authorized personnel to insert a key (not illustrated) to the door lock 30 through the open distal shield end 25 and into the key opening in order to open the door lock 30.

In the event that authorized personnel deems it necessary to open the enclosure door 10 to access the enclosure interior 7, a key (not illustrated) to the door lock 30 may be inserted into the key opening (not illustrated) in the door lock 30 to unlock and facilitate removal of the door lock 30 from the registering enclosure flange opening 16 in the enclosure flange 15 and the door flange opening 19 in the door flange 18. The enclosure door 10 can then be pivoted to the open position on the enclosure door hinges 27 as the enclosure flange 15 of the door latch 14 is typically withdrawn from the lock shield interior 26 of the lock shield 22 through the enclosure flange slot 17.

It will be appreciated by those skilled in the art that as the enclosure door 10 remains in the closed position on the enclosure 2 of the system 1, the enclosure mounting assembly 34 remains locked in the enclosure interior 7, and thus, inaccessible to unauthorized personnel. Thus, the enclosure 2 and its contents are substantially incapable of theft since the enclosure 2 remains securely attached to the enclosure mount member 35 during use. This advantage facilitates secure storage of the articles, components and/or other items which are contained in the enclosure 2.

Figure 16:
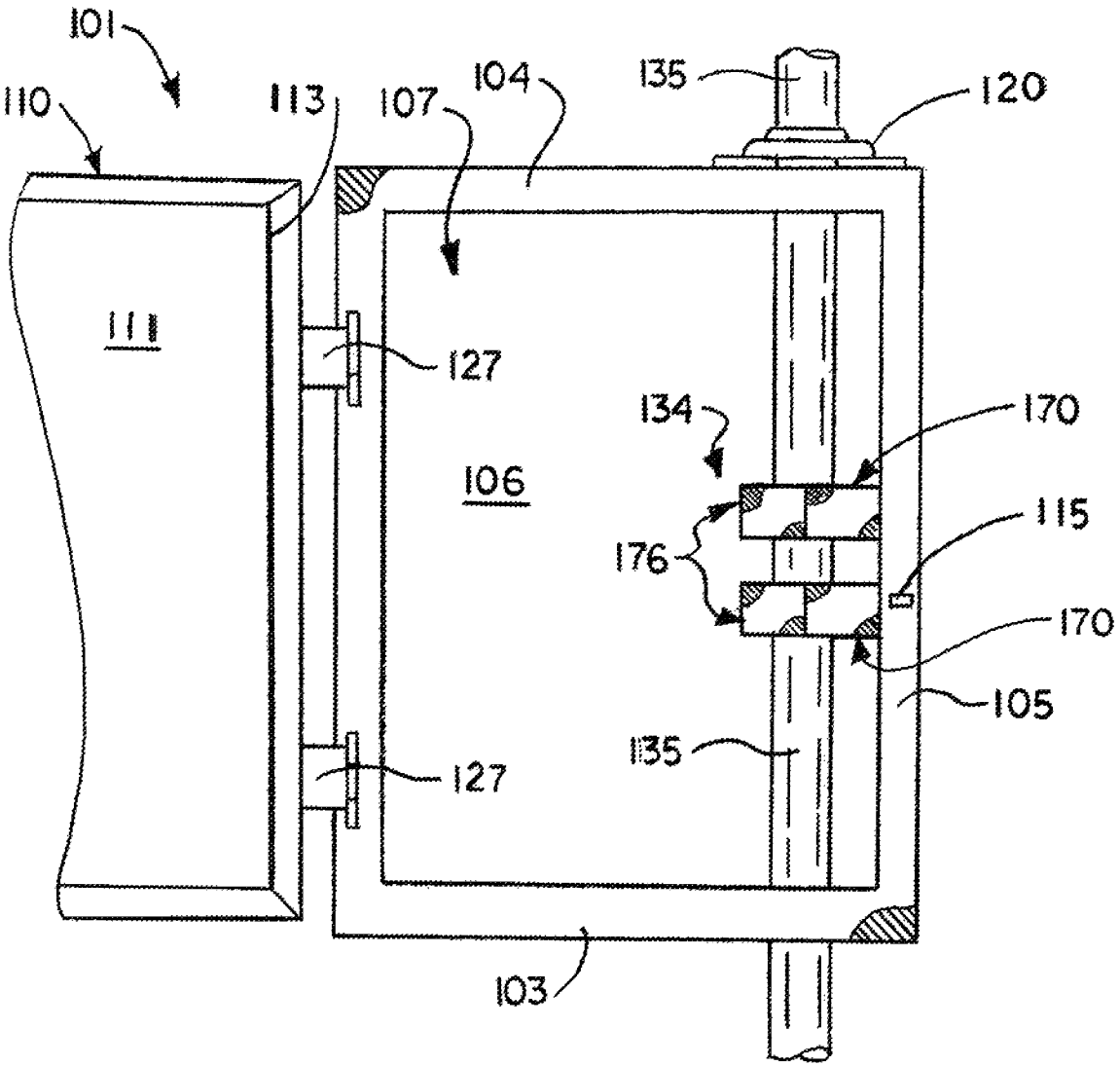
FIG. 16 is a front view of an alternative illustrative embodiment of the theft-resistant enclosure systems with the enclosure door (partially in section) opened and the enclosure mounting assembly shown in the enclosure interior of the enclosure.
Figure 17:
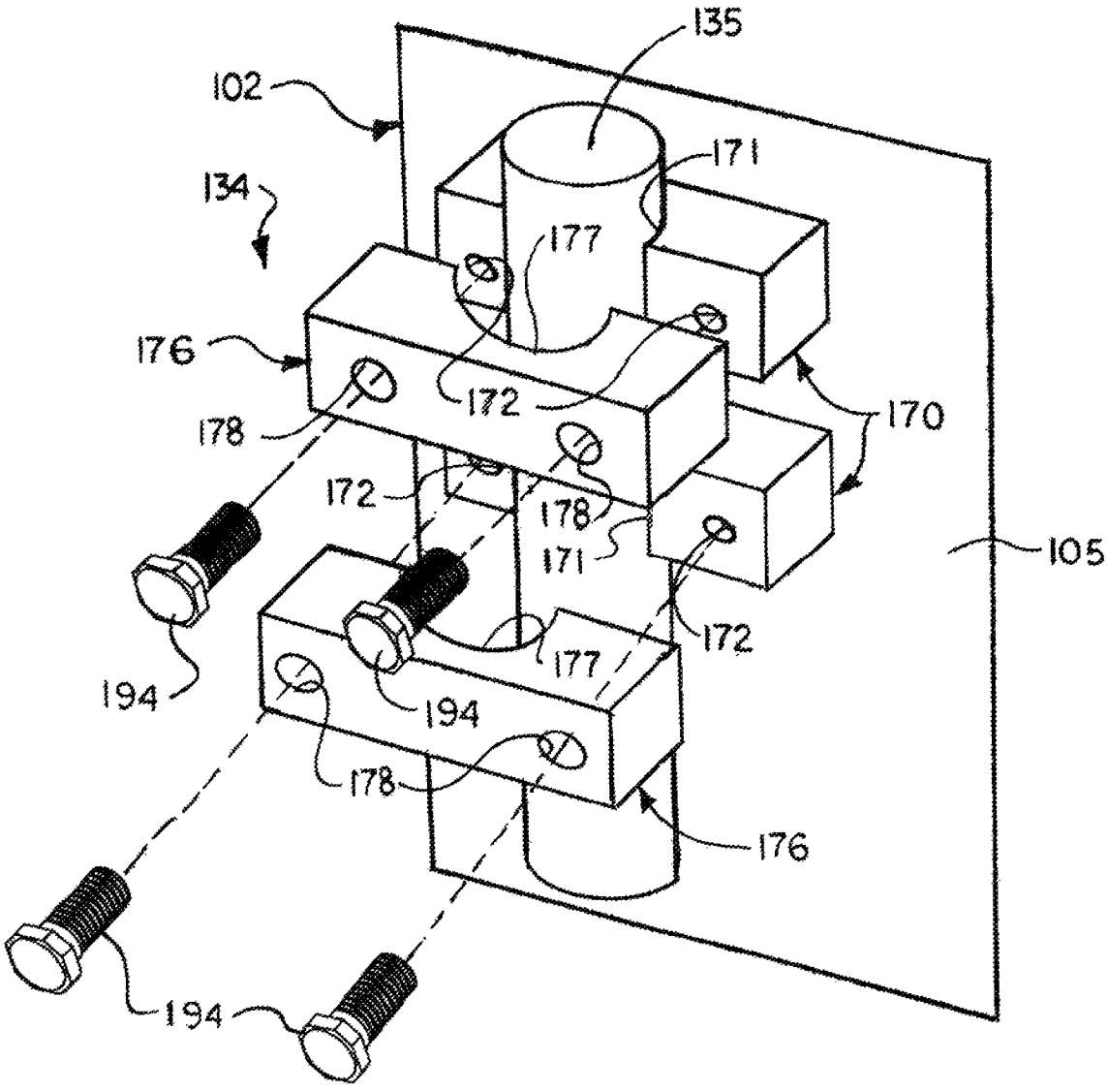
FIG. 17 is an exploded perspective view of the illustrative theft-resistant enclosure system illustrated in FIG. 15.

Referring next to FIGS. 16 and 17 of the drawings, an alternative illustrative embodiment of the theft-resistant enclosure systems is generally indicated by reference numeral 101. In the system 101, elements which are analogous to the respective elements of the system 1 that was heretofore described with respect to FIGS. 1-14 are designated by the same respective reference numerals in the 101-199 series in FIGS. 16 and 17. Unless otherwise noted herein, the system 101 may have components and features which are the same as or similar to those which where heretofore described with respect to the theft-resistant enclosure system 1.

The enclosure mounting assembly 134 of the system 101 may include at least one fixed bracket 170. Each fixed bracket 170 may be fixedly attached to an interior surface of the enclosure 102. At least one removable bracket 176 may detachably engage each fixed bracket 170. The enclosure mount member 135 may be sandwiched between the fixed bracket 170 and the removable bracket 176 such that the fixed bracket 170 and the removable bracket 176 of the enclosure mounting assembly 134 secure the enclosure 102 to the enclosure mount member 135.

In some embodiments, each fixed bracket 170 may be fixedly attached to the interior surface of one of the enclosure side walls 105 of the enclosure 102, as illustrated. In other embodiments, each fixed bracket 170 may be fixedly attached to the interior surface of the enclosure rear wall 106 or other component of the enclosure 102. In some embodiments, each fixed bracket 170 may be welded to the enclosure side wall 105. In other embodiments, each fixed bracket 170 may be attached to the enclosure side wall 105 using bolts and/or other mechanical fasteners which are suitable for the purpose according to the knowledge of those skilled in the art.

As illustrated in FIG. 17, each fixed bracket 170 may have a fixed bracket mount member cavity 171 which is substantially complementary to the size and contour of approximately one-half of the enclosure mount member 135. Accordingly, the fixed bracket mount member cavity 171 may receive the enclosure mount member 135 of the enclosure mounting assembly 134 typically as will be hereinafter further described. In some embodiments, at least one fixed bracket bolt opening 172 may be provided in each lower fixed bracket 170 for purposes which will be hereinafter described.

Each removable bracket 176 may interface with each fixed bracket 170. In some embodiments, each removable bracket 176 may be substantially complementary in size and shape to each corresponding fixed bracket 170. Accordingly, each removable bracket 176 may have a mount member cavity 177 which may be substantially complementary to the size and contour of approximately one-half of the enclosure mount member 135. Therefore, the mount member cavity 177 may be configured to receive the side of the enclosure mount member 135 which is opposite that received by the mount member cavity 171 in the corresponding fixed bracket 170. In some embodiments, at least one removable bracket bolt opening 178 may be provided in each removable bracket 176. Accordingly, each removable bracket 176 may be detachably attached to each corresponding fixed bracket 170 by placing the removable bracket 176 against the fixed bracket 170 as the removable bracket mount member cavity 177 receives the enclosure mount member 135 and the removable bracket bolt openings 178 in the removable bracket 176 align or register with the respective fixed bracket bolt openings 172 in the fixed bracket 170. Bracket bolts 194 may then be extended through the respective removable bracket bolt openings 178 in the removable bracket 176 and threaded into the respective registering fixed bracket bolt openings 172 in the fixed bracket 170.

Application of the system 101 may be as was heretofore described with respect to the system 1 in FIGS. 1-15. Accordingly, the fixed brackets 170 may be welded and/or otherwise attached to the interior surface of the enclosure 102. The enclosure mount member 135 may be installed in the enclosure 102 through the lower mount member opening 8 and upper mount member opening 9, typically as was heretofore described with respect to FIG. 12, with the enclosure mount member 135 typically extending into the fixed bracket mount member cavity 171 of each fixed bracket 170. The removable brackets 176 may then be placed against the respective fixed brackets 170, with the removable bracket mount member cavity 177 of each removable bracket 176 receiving the enclosure mount member 135, and each removable bracket 176 attached to the corresponding fixed bracket 170 typically via the bracket bolts 194. The enclosure mounting assembly 134 may thus prevent theft of the enclosure 102 and its contents by securing the enclosure 102 to the enclosure mount member 135 of the enclosure mounting assembly 134 in the enclosure interior 107. In some embodiments, the system 101 may be fitted with the lock shield assembly 21 which was heretofore described with respect to FIGS. 1, 13 and 14.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A theft-resistant enclosure system, comprising:

an enclosure having an enclosure interior;

an enclosure door carried by the enclosure, the enclosure door selectively positional in opened and closed positions and selectively lockable in the closed position;

at least one enclosure mount member extending through the enclosure interior of the enclosure;

at least one anchoring device anchoring the at least one enclosure mount member outside the enclosure interior of the enclosure;

at least one enclosure mounting assembly in the enclosure interior of the enclosure, the at least one enclosure mounting assembly securing the enclosure to the at least one enclosure mount member;

at least one mount member opening in the enclosure, and wherein the at least one enclosure mount member extends from the enclosure interior through the at least one mount member opening; and at least one attachment cap attaching the enclosure to the at least one enclosure mount member.

2. The theft-resistant enclosure system of claim 1 wherein the enclosure comprises an enclosure floor, an enclosure top wall, a pair of spaced-apart enclosure side walls and an enclosure rear wall, and the at least one mount member opening comprises at least one lower mount member opening in the enclosure floor and at least one upper mount member opening in the enclosure top wall.

3. The theft-resistant enclosure system of claim 1 further comprising a door latch carried by the enclosure and the enclosure door and latching the enclosure door in the closed position and a door lock configured to engage the door latch.

4. A theft-resistant enclosure system, comprising:

an enclosure having an enclosure interior;

an enclosure door carried by the enclosure, the enclosure door selectively positional in opened and closed positions and selectively lockable in the closed position;

at least one enclosure mount member extending through the enclosure interior of the enclosure;

at least one anchoring device anchoring the at least one enclosure mount member outside the enclosure interior of the enclosure;

at least one enclosure mounting assembly in the enclosure interior of the enclosure, the at least one enclosure mounting assembly securing the enclosure to the at least one enclosure mount member;

a door latch carried by the enclosure and the enclosure door and latching the enclosure door in the closed position and a door lock configured to engage the door latch; and wherein the door latch comprises an enclosure flange extending from the enclosure, an enclosure flange opening extending through the enclosure flange, a door flange extending from the enclosure door and a door flange opening extending through the door flange, and wherein the door flange opening in the door flange aligns or registers with the enclosure flange opening in the enclosure flange in the closed position of the enclosure door.

5. The theft-resistant enclosure system of claim 4 further comprising a lock shield assembly carried by the enclosure door and configured to enclose the door latch and the door lock in the closed position of the enclosure door.

6. The theft-resistant enclosure system of claim 5 wherein the lock shield assembly comprises a lock shield having a lock shield wall with a proximal shield end at an exterior surface of the enclosure door, a distal shield end opposite the proximal shield end and a lock shield interior extending from the proximal shield end to the distal shield end, and the door flange of the door latch extends into the lock shield interior; and further comprising an enclosure flange slot in the enclosure door, the enclosure flange slot configured to receive the enclosure flange of the door latch in the closed position of the enclosure door.

7. The theft-resistant enclosure system of claim 1 wherein the at least one enclosure mount member comprises at least one pole or post.

8. A theft-resistant enclosure system, comprising:

an enclosure having an enclosure interior;

an enclosure door carried by the enclosure, the enclosure door selectively positional in opened and closed positions and selectively lockable in the closed position;

at least one enclosure mount member extending through the enclosure interior of the enclosure;

at least one anchoring device anchoring the at least one enclosure mount member outside the enclosure interior of the enclosure; and at least one enclosure mounting assembly in the enclosure interior of the enclosure, the at least one enclosure mounting assembly securing the enclosure to the at least one enclosure mount member and including:

at least one main support member carried by the enclosure; and at least one securing member engaging the at least one main support member and the at least one enclosure mount member.

9. The theft-resistant enclosure system of claim 8 further comprising at least one alignment bracket engaging the at least one enclosure mount member opposite the at least one securing member, the at least one alignment bracket disposed between the at least one enclosure mount member and the at least one main support member.

10. The theft-resistant enclosure system of claim 9 further comprising at least one mount member cavity in the at least one alignment bracket and receiving the at least one enclosure mount member.

11. The theft-resistant enclosure system of claim 9 wherein the at least one main support member comprises a pair of spaced-apart main support members.

12. The theft-resistant enclosure system of claim 11 wherein the at least one securing member comprises a pair of spaced-apart securing member arms and a mount member engaging portion extending between the securing member arms, the mount member engaging portion configured to engage the at least one enclosure mount member.

13. The theft-resistant enclosure system of claim 12 further comprising at least one pair of support member apertures in the pair of spaced-apart main support members, respectively, and wherein the pair of spaced-apart securing member arms of the at least one securing member extend through the at least one pair of support member apertures, respectively.

14. The theft-resistant enclosure system of claim 12 further comprising a pair of arm openings in the alignment bracket, the pair of arm openings configured to receive the pair of spaced-apart securing member arm of the at least one securing member.

15. The theft-resistant enclosure system of claim 12 further comprising a plurality of threads on each of the pair of spaced-apart securing member arms of the at least one securing member and a nut threadably engaging the plurality of threads.

16. The theft-resistant enclosure system of claim 11 wherein each of the pair of spaced-apart main support members has a channel shape in cross-section.

17. A theft-resistant enclosure system, comprising:

an enclosure having an enclosure interior;

an enclosure door carried by the enclosure, the enclosure door selectively positional in opened and closed positions and selectively lockable in the closed position;

at least one enclosure mount member extending through the enclosure interior of the enclosure;

at least one anchoring device anchoring the at least one enclosure mount member outside the enclosure interior of the enclosure; and at least one enclosure mounting assembly in the enclosure interior of the enclosure, the at least one enclosure mounting assembly securing the enclosure to the at least one enclosure mount member and including:

at least one fixed bracket carried by the enclosure in the enclosure interior;

at least one fixed bracket mount member cavity in the at least one fixed bracket, the at least one fixed bracket mount member cavity receiving the at least one enclosure mount member;

at least one removable bracket carried by the at least one fixed bracket; and at least one removable bracket mount member cavity in the at least one removable bracket, the at least one removable bracket cavity receiving the at least one enclosure mount member.

18. The theft-resistant enclosure system of claim 17 wherein the at least one fixed bracket comprises a plurality of fixed brackets, and the at least one removable bracket comprises a plurality of removable brackets.

* * * * *